US005079993A

United States Patent [19]

Forster

[11] Patent Number: 5,079,993

[45] Date of Patent: Jan. 14, 1992

[54] AXIAL PISTON MACHINE

[75] Inventor: Franz Forster, Karlstadt-Muhlbach, Fed. Rep. of Germany

[73] Assignee: Linde Aktiengesellschaft, Fed. Rep. of Germany

[21] Appl. No.: 467,935

[22] Filed: Jan. 22, 1990

[30] Foreign Application Priority Data

Feb. 17, 1989 [DE] Fed. Rep. of Germany ..... 3904782

[51] Int. Cl.[5] ..... F01B 15/06

[52] U.S. Cl. ..... 91/484; 91/504

[58] Field of Search ..... 91/484, 499, 504, 505, 91/506, 485; 417/269

[56] References Cited

U.S. PATENT DOCUMENTS

| | | | |
|---|---|---|---|
| 3,110,267 | 11/1963 | Vetter | 91/485 |
| 3,292,553 | 12/1966 | Hann | 91/485 |
| 4,475,443 | 10/1984 | Forster | 91/499 |
| 4,690,036 | 9/1987 | Kosaka | 91/506 |
| 4,896,585 | 1/1990 | Forster | 91/505 |

FOREIGN PATENT DOCUMENTS

| | | |
|---|---|---|
| 37131 | 4/1959 | Luxembourg . |
| 8701760 | 3/1987 | PCT Int'l Appl. . |
| 8906750 | 7/1989 | PCT Int'l Appl. . |
| 334059 | 12/1958 | Switzerland . |

*Primary Examiner*—Richard A. Bertsch
*Assistant Examiner*—Peter Korytnyk
*Attorney, Agent, or Firm*—Webb, Burden, Ziesenheim & Webb

[57] ABSTRACT

An axial piston machine having a longitudinally movable rotary cylindrical drum with cylindrical bores arranged concentrically to the axis of rotation of the drum. A longitudinally sliding piston located in each bore and lying against a control surface in contact with the drum. The pistons have an end in contact with a control surface that can be positioned diagonally to the axis of rotation of the drum and said cylindrical bores are provided with openings connecting to control channels in the control surface. Additional piston surfaces are provided in a cavity formed in the cylindrical drum for controlling the pressing force of the cylindrical drum on the control surface.

3 Claims, 4 Drawing Sheets

AXIAL PISTON MACHINE

BACKGROUND OF THE INVENTION

1. Field of the Invention

This invention relates to an axial piston machine with a rotating cylindrical drum, which has a multiplicity of cylindrical bores arranged concentrically to the axis of rotation with pistons capable of sliding longitudinally therein. The drum lies against a control surface adjacent the housing., in which case the pistons are in contact with a working surface that can be positioned diagonally to the axis of rotation and the cylindrical bores are provided with connecting openings to the control channels of the control surface, whereby the cylindrical drum is also supported in a longitudinally moveable manner. More particularly, the invention relates to such a machine wherein additional means is provided for controlling the pressing force of the cylindrical drum on the control surface, which is in working connection with the cylindrical drum.

2. Description of the Art

When such machines are used as pumps, especially as self-priming pumps, it is desirable that the pump have as high a suction rate as possible in order to minimize the filling losses caused by flow losses on the suction side and the resulting reduction in the delivery volume. The flow losses are a function of the flow velocity of the flow medium in the suction channel of the pump and the design of the latter. It is therefore necessary that the suction channel have as large a cross section as possible to keep the flow velocity and thus the pipe friction and flow losses low.

In the case of axial piston machines, there is a peculiarity that also leads to filling losses. This consists in the structurally induced gap between the housing control surface, which contains the orifices of the suction channel, designed as kidney-shaped control channels, and the rotating cylindrical drum lying against them. The gap is necessary so that a hydrostatic film of lubrication can form between the webs of the control surface and those of the cylindrical drum, which reduces the friction and facilitates disturbance-free and easy running of the machine. However, external leakage streams are caused by the gap, as well as inner leakage streams that flow directly from the high-pressure side to the low-pressure side of the control surface. The loss stream that results reduces the volumetric efficiency of the machine and thus the actual delivery volume. In order to achieve a satisfactory volumetric efficiency, the gap between the rotating cylindrical drum and the control surface must be kept as small as possible. This is achieved by a pressure spring which presses the cylindrical drum against the control surface and also by a connection which is produced between the cylindrical bores and the control channels through openings whose diameter is smaller than the diameter of the cylindrical bores. Through the latter measure, the cylindrical drum is pressed into the cylindrical bores against the control surface due to the fluid pressure, in which case the contact pressure is proportional to the loading of the machine. The leakage streams and/or filling losses of the axial piston machine are thus held at a low level.

The narrowed connection openings between the cylindrical bores and the control channels represent a constriction of the suction channel, which leads in the case of a certain desired delivery volume to a certain flow velocity in this region and thus to flow losses and, in accordance with the flow rate, to a restriction in the suction power of such a machine versus a machine lacking this structural means.

The geometric relationships on the suction side are thus essentially prescribed by the power and moment equilibrium between the hydrostatic release of the rotating cylindrical drum and limitation of the relief gap.

An axial piston machine of swash plate construction is disclosed in German patent DE-OS 22 50 510, in which an additional device situated around the outside diameter of the cylindrical drum induces an increase in the pressing force of the cylindrical drum on the control surface. A disadvantage in this device, however, is that it increases the structural volume of the axial piston machine substantially and leads to a complicated and expensive construction.

The present invention proposes to avoid those shortcomings and increase the suction ability of an axial piston machine in an economical manner.

SUMMARY OF THE INVENTION

According to the present invention, an axial piston machine with a cylindrical drum that lies against a control surface provided with control channels includes means for controlling the pressing force of the cylindrical drum on the control surface for increasing the suction ability. To increase the suction ability of the axial piston machine in an economical manner while retaining a small structural volume, the additional means is provided in a cavity between the inner surface of the cylindrical drum and the outer surface of the drive shaft. The additional means comprises at least one annular space that is formed by a hollow cylindrical inner surface of the cylindrical drum and two annular pistons capable of sliding longitudinally with respect to each other and arranged co-axially to the axis of rotation and is connected through connecting channels with the control channels and can be acted upon by high pressure, by which an additional pressing force can be exerted on the cylindrical drum.

The additional means can be thus obtained without the need for additional space and with simple means; it controls the pressing force of the cylindrical drum on the control surface, e.g., increasing it. An additional axial force is thus generated in the direction of the control surface. The additional contact pressure thus obtained can be used for an amplification of the kidney-shaped control channels in the control surface and the connection openings to the cylindrical bores, corresponding to the power and moment equilibrium. In some cases, the diameter of the connection openings can match the diameter of the cylindrical bores. A clear improvement in the suction capacity of the axial piston machine and an increase in the possible suction r.p.m. result in every case, which is advantageous, especially in machines that operate in an open cycle. An increase in the suction r.p.m. means that the machine can be capable of suction in an r.p.m. range that facilitates operation through a directly connected driving engine, so that reduction gearing, which was previously necessary, can be eliminated. This results in an increase in efficiency in such a unit.

The present invention can also be used for machines that operate in a closed cycle. The control channels can be enlarged and the webs between them can be broadened. The additional hydrostatic release of the cylindrical drum caused by a web broadening is then compensated by the axial force generated by the means.

It has proved advantageous if the additional means contains at least one piston surface that can be acted upon with operating pressure as a function of the delivery stream. The force of the cylindrical drum pressing on the control surface is controlled by the flow medium under the operating pressure that acts on the piston surface. The flow medium is drawn from the high-pressure control channels. The piston surface is thus loaded with flow medium under corresponding high pressure as a function of the load or the delivery stream of the machine.

The arrangement of the additional means can be used in machines whose cylindrical drum is supported in a longitudinally moveable manner on a drive shaft that passes through it centrally, as well as in machines that have no such central shaft.

In an advantageous embodiment of the invention, in which the additional means presses the cylindrical drum against the control surface and the cylindrical drum has a drive shaft passing through it centrally, the piston surface is formed between a hollow cylindrical inner surface of the cylindrical drum and two annular pistons that slide lengthwise with respect to each other and are arranged co-axially to the axis of rotation. The first annular piston has an axial support on the cylindrical drum and is capable of moving longitudinally with respect to the drive shaft and the second annular piston has an axial support on the drive shaft and is longitudinally moveable with respect to the cylindrical drum. The additional means can thus be constructed of only a few easily producable components and requires little space.

In another embodiment of the invention, the additional means has a direction of action away from the control surface. The cylinder block that is pressed by a pressure spring and, due to the pressure, into the cylindrical bores and the narrowings of the connection openings against the control surface thus undergoes a pressure-dependent release, which reduces the friction in the gap. Under certain conditions, i.e., if the axial force resulting from the relief pressure corresponds to the spring force, the force of the pressure spring is completely cancelled and the only force that still acts on the cylinder block is that resulting from the pressure in the cylindrical bores, and opposing it the hydrostatic release force in the gap. If the release pressure remains below a certain value, the full spring force acts on the cylindrical drum, by which higher r.p.m. are attainable, with no tipping of the cylindrical drum.

Hence, the additional means preferably comprises an annular piston arranged co-axially to the axis of rotation between a cylindrical outer surface of the drive shaft and a hollow cylindrical inner surface of the cylindrical drum. The piston is longitudinally moveable with respect to both the cylindrical drum and the drive shaft and with a cylindrical outer surface in connection with a hollow cylindrical inner surface of the cylindrical drum forms at least one annular space. In this case, the annular piston in the pressureless state of the axial piston machine has an initial end position, in which a pressure spring located between a hollow cylindrical inner surface of the annular piston and the cylindrical outer surface of the drive shaft has as large an axial extension as possible and the annular piston lies on a stop of the drive shaft. In the case of a given load of the axial piston machine, a second end position of the annular piston is provided, in which the pressure spring has as small an axial extension as possible and the annular piston lies on a stop of the cylindrical drum. When a certain pressure level is exceeded in the annular space, the annular piston moves into its second end position, so that the pressure spring no longer lies on the stop on the drive shaft and thus can no longer exert a pressing force on the cylindrical drum because the axial reaction force is no longer taken up by the drive shaft. Such a construction also has a low production cost. The pressure spring already present is supplemented only by an annular piston.

It is advantageous if at least one connecting channel located in the cylindrical drum is provided between the annular space and at least one of the control channels in the control surface. The connecting channel or channels can be readily introduced during production of the cylindrical drum. The drive shaft itself remains free of bore holes and grooves.

In axial piston machines with a device for adjusting the delivery volume and reversal of the direction of flow, e.g., a bilaterally pivotable axial piston pump of swash plate construction, according to another embodiment of the invention, at least one annular space and at least one connecting channel are assigned to each direction of flow. The additional means can be used in this case independently of the direction of flow, so that in each case the flow losses are reduced on both the suction and the pressure sides. It is desirable for this purpose if for the first direction of flow a multitude of connecting channels are spaced from each other concentrically to the axis of rotation on an initial graduated circle by an approximately identical angle, and for a second direction of flow a multitude of connecting channels are spaced by an approximately identical angle from each other concentrically to the axis of rotation on a second graduated circle. The annular space is thus loaded approximately uniformly with high pressure.

The invention will be understood and appreciated from a perusal of the specification taken with the following schematic representations showing one exemplary embodiment with several variants.

DESCRIPTION OF THE PREFERRED EMBODIMENTS

Figure 1:
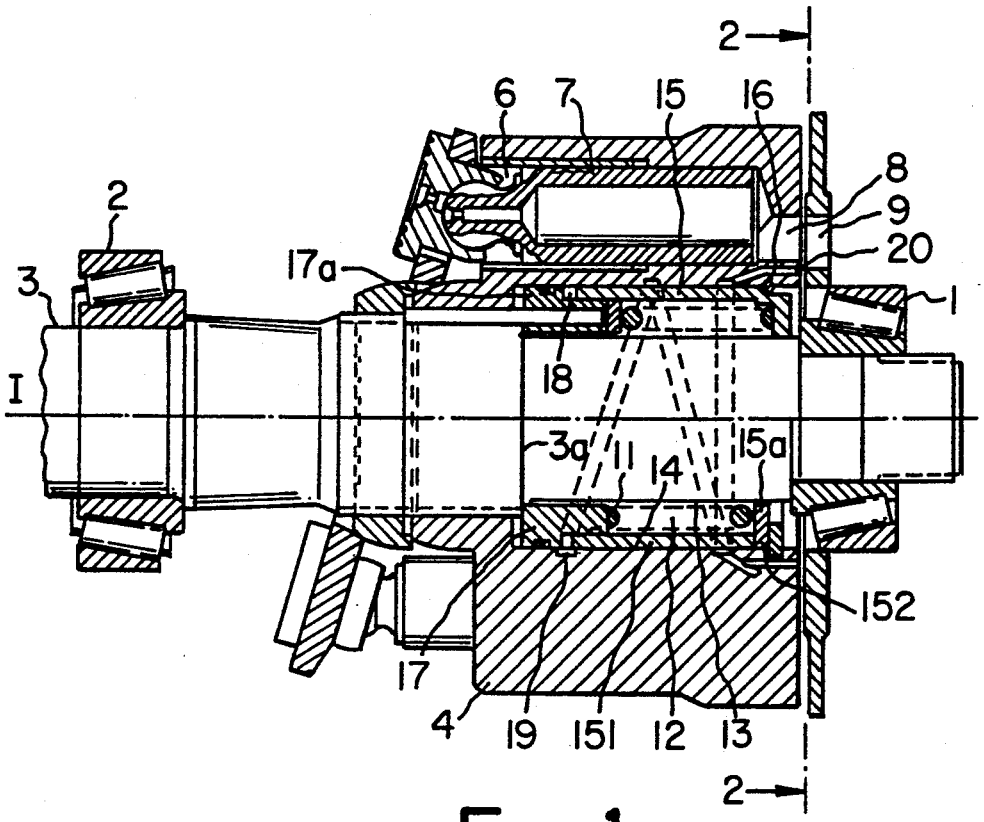
FIG. 1 is an axial section on line 1—1 of FIG. 2 showing an embodiment of an axial piston machine according to the invention.

The essential components of an axial piston machine according to the invention, in this example an axial piston machine of swash plate construction, are shown in the drawings wherein the housing and the working surface of the piston as well as some adjustment devices have not been shown.

Figure 2:
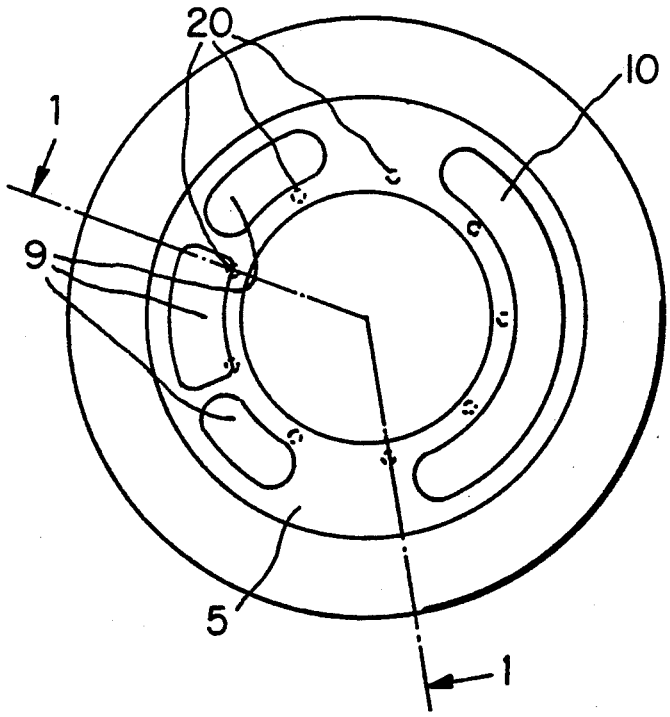
FIG. 2 is a section on line 2—2 of FIG. 1 showing a control surface of the axial piston machine shown in FIG. 1.

A swash plate pump has a drive shaft 3 supported by bearings 1 and 2. The drive shaft 3 passes centrally through a cylindrical drum 4 and is connected with it in a rotationally contacting manner. The cylindrical drum 4 is longitudinally moveable within certain limits with respect to the drive shaft 3, which is achieved for example by a spline. The axial section shown in FIG. 1 is taken on section line 1—1 of FIG. 2. FIG. 2 in turn represents a section on line 2—2 of FIG. 1. The same drawing conventions apply for FIGS. 3-8.

An end of cylindrical drum 4 is located against control surface 5. The drum has a multitude of cylindrical bores 6 in which longitudinally moveable pistons 7 are located. The cylindrical bores 6 are arranged concentrically to the axis of rotation I of the drive shaft 3. The pistons 7 are connected with a working surface (not shown) that can be positioned obliquely to the axis of rotation. When the drive shaft 3 rotates, a piston stroke is induced in the conventional manner. The cylinder bores 6 are connected to control channels 9 and 10 of the control channel surface 5 by means of connecting openings 8 in certain rotational positions of the cylindrical drum 4. The connecting openings 8 are smaller in cross section than the cylindrical bores 6 so that the cylindrical drum 4 is pressed against the control surface 5 when a load-dependent pressure is present in the cylindrical bores 6. A hydrostatic relieving force, which acts in a known manner between the front face of the cylindrical drum 4 and the control surface 5, is directed against the axial force thus generated. In order to effect a certain pressing of the cylindrical drum 4 on the control surface 5 in the pressureless state of the swash plate pump and at a low pressure, a pressure spring 11 is provided, which is located in this embodiment inside the cylindrical drum 4 in an annular cavity 12 between a cylindrical outer surface 13 of the drive shaft 3 and a hollow cylindrical inner surface 14 of the cylindrical drum 4 co-axially to the axis of rotation I. The pressure spring 11 rests on the cylindrical drum 4 with its right end in the axial section via an annular piston 15 and a retaining ring 16. The annular piston 15 can also be made in several parts, as illustrated in the modification shown in the lower half of the axial section, namely of two parts 151 and 152, of which the latter forms a radial support flange **15*a* that projects inwardly toward the axis of rotation I. The annular piston 15 is moveable longitudinally with respect to both the inner wall 14 of the cylindrical drum 4 and the drive shaft 3, where the longitudinal movement with respect to the inner wall 14 of the cylindrical drum 4 is limited by the retaining ring 16 and makes contact with the hollow cylindrical inner surface 14 of the cylindrical drum 4 with its cylindrical outer surface. The annular cavity 12 in which the pressure spring 11 is located is situated between the cylindrical outer surface 13 of the drive shaft 3 and the inner surface of the annular piston 15**.

The annular cavity 12 is closed off at one axial end by the support flange **15*a* and at the opposite axial end by a second annular piston 17, which forms an abutment for the pressure spring 11. The annular piston 17 is also axially moveable with respect to both the hollow cylindrical inner surface 14 of the cylindrical drum 4 and the drive shaft 3, in which case the axial movement relative to the drive shaft 3 is restricted by a collar 3*a* of the drive shaft 3. The pressure spring 11 is thus tensioned between the cylindrical drum 4 and the drive shaft 3**.

The second annular piston 17 has a collar **17*a* oriented radially outwardly with respect to the axis of rotation I; its cylindrical outer surface lies on the hollow cylindrical inner surface 14 of the cylindrical drum 4. The first annular piston 15, together with the second annular piston 17 and the hollow cylindrical inner surface 14 of the cylindrical drum 4, form an annular space 18, which can be connected with at least one of the control channels 9 via a channel 19, which in this embodiment is essentially helical, and connection channels 20 in the cylindrical drum 4. The control channels 9 are under load-dependent high pressure when the pump is running. The connecting channels 20** are concentric to the axis of rotation I on a common graduated circle.

The number of connection channels 20 is basically arbitrary. However, the number and angular spacing are preferably chosen such that when the cylindrical drum 4 is rotating, at least one connecting channel 20 is always connected to a control channel 9. A connection to the control channel 10 of the control surface 5 is not provided in the embodiment shown in FIG. 1 because the swash plate pump is designed to have only one direction of throughflow.

The flow medium under high pressure passes from the control channels 9 through the connecting channels 20 and the channel 19 into the annular space 18, where it attempts to separate the annular pistons 15 and 17 from each other. A load-dependent additional pressing force is thus generated that presses the cylindrical drum 4 against the control surface 5. The additional means required for this consists, as described, only of the annular pistons 15 and 17, the channel 19 and the connecting channels 20.

Figure 3:
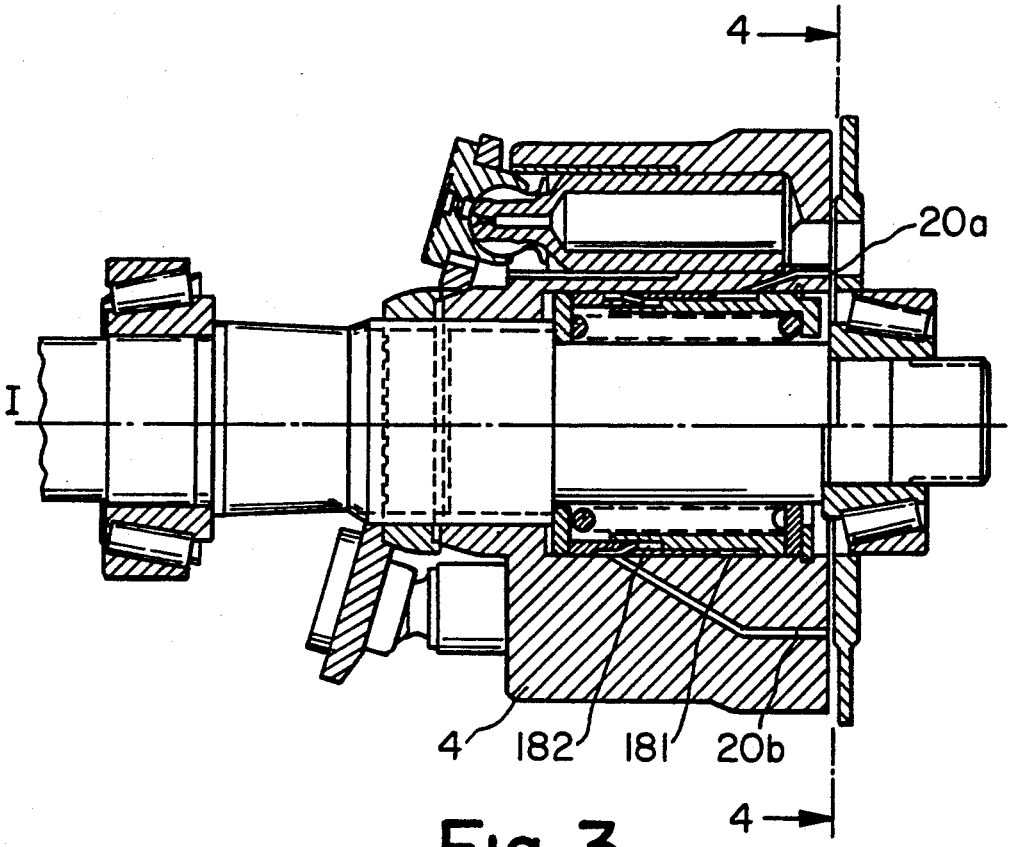
FIG. 3 is an axial section on line 3—3 of FIG. 4 showing a second embodiment of an axial piston machine according to the invention.
Figure 4:
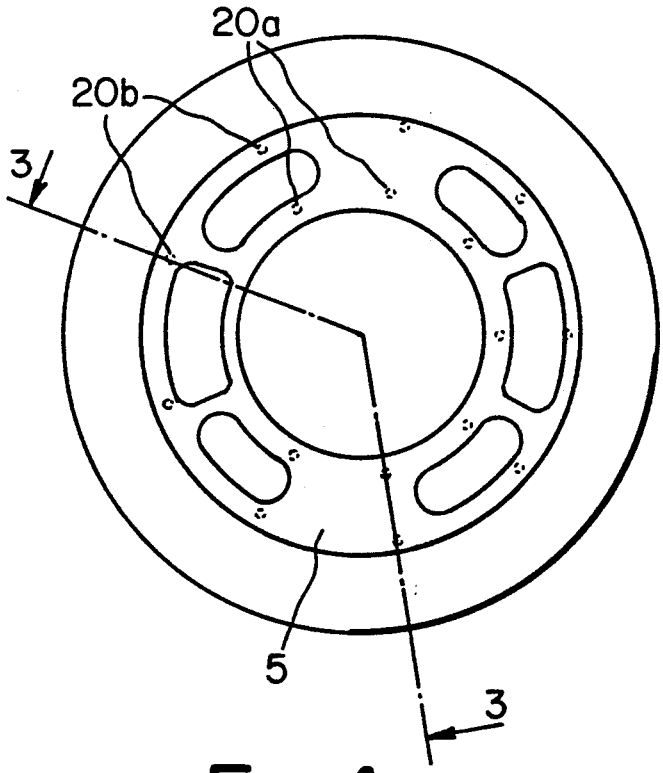
FIG. 4 is a section on line 4—4 of FIG. 3 showing a control surface of the axial piston machine shown in FIG. 3.

The embodiment shown in FIGS. 3 and 4 differs from that shown in FIG. 1 in that the swash plate pump is designed for operation with different directions of flow, i.e., the swash plate can be swung from the zero position in two directions and back again. The additional means can thus operate bilaterally; two annular spaces 181 and 182 are provided to effect this mode of operation. The annular space 181 is connected to the connecting channels **20*a* and the annular space 182 to the connecting channels 20*b*. The connecting channels 20*a* are spaced by an approximately identical angular amount from each other on an initial inner graduated circle and are loaded with high pressure in an initial direction of flow. The connecting channels 20*b* are spaced by an approximately identical angular amount from each other on a second outer graduated circle. If the direction of flow changes, the connecting channels 20*b* are under high pressure. Independently of the direction of flow, one of the annular spaces 181 or 182 is thus always acted upon by high pressure in a load-dependent manner so that the additional means is active and presses the cylindrical drum 4 against the control surface 5**.

Figure 5:
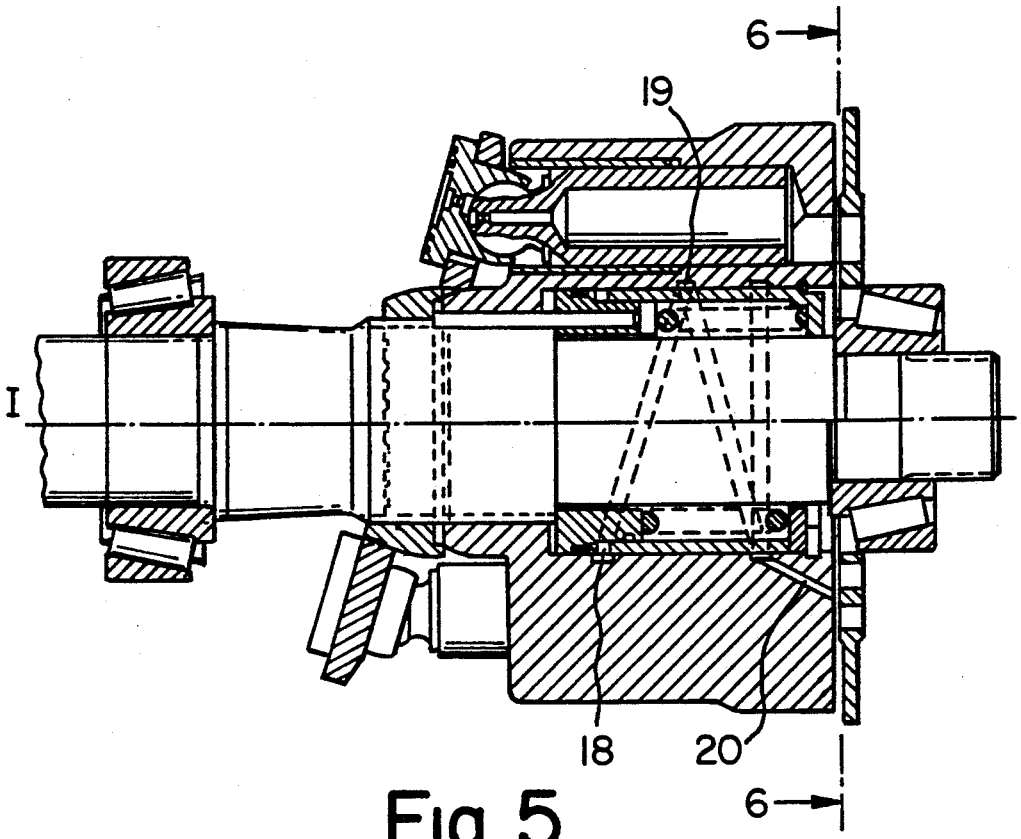
FIG. 5 is an axial section on line 5—5 of FIG. 6 showing a third embodiment of an axial piston machine according to the invention.
Figure 6:
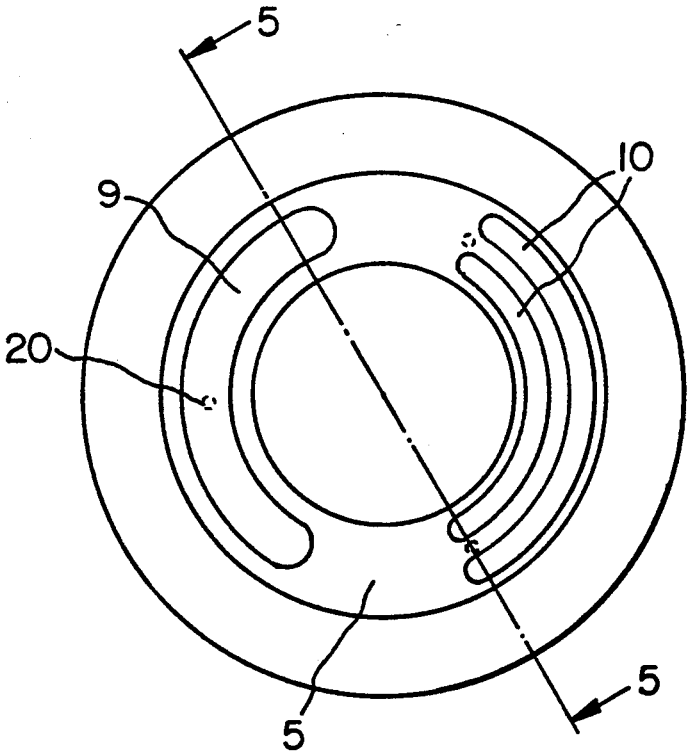
FIG. 6 is a section on line 6—6 of FIG. 5 showing a control surface of the axial piston machine shown in FIG. 5.

"The embodiment shown in FIGS. 5 and 6 has a swash" plate pump with only one direction of flow. In this embodiment, only three connecting channels 20 arranged with a spacing of 120° on a graduated circle are required due to the configuration of the control channels 9 and 10 in the control surface 5 in order to achieve a uniform loading of the annular space 18 with high pressure.

Figure 7:
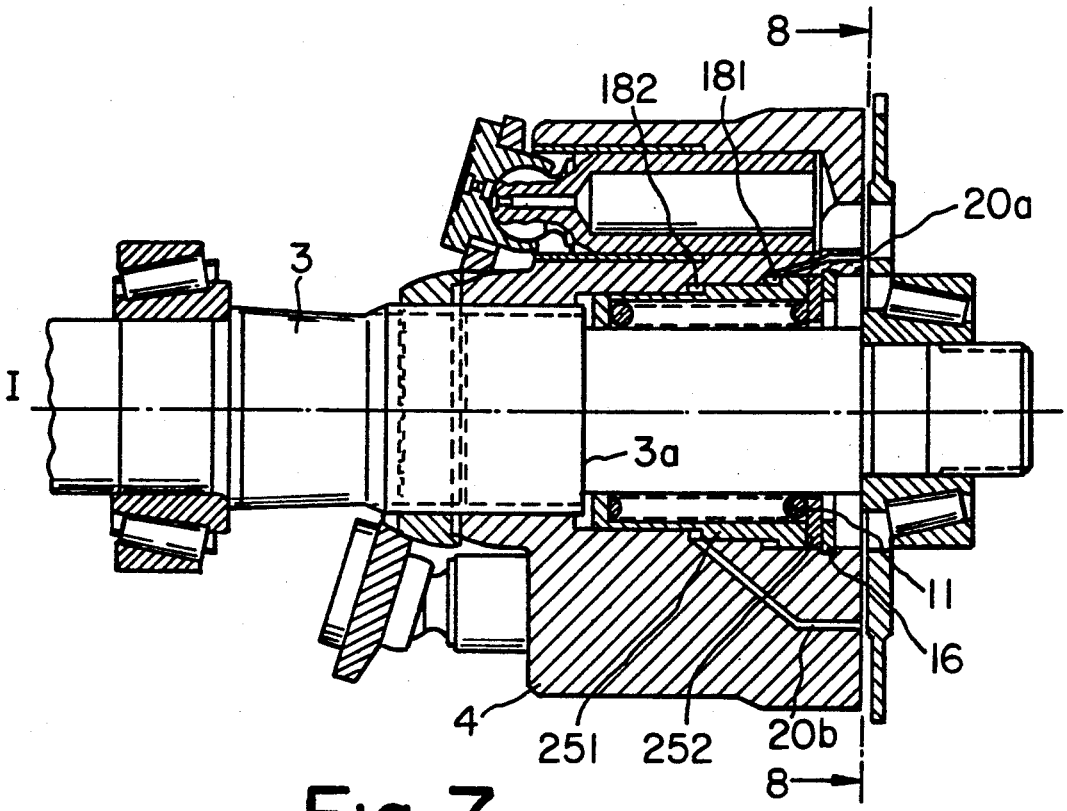
FIG. 7 is an axial section on line 7—7 of FIG. 8 showing a fourth embodiment of an axial piston machine according to the invention.
Figure 8:
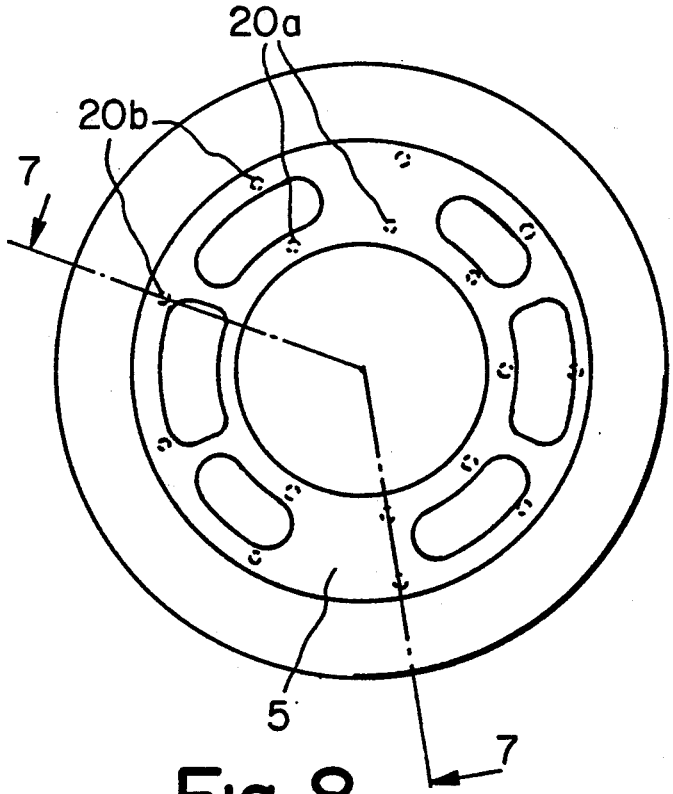
FIG. 8 is a section on line 8—8 of FIG. 7 showing a control surface of the axial piston machine shown in FIG. 7.

A swash plate pump with two possible directions of flow is shown in FIGS. 7 and 8, in which the additional means relieves the cylindrical drum in operation. Instead of two annular pistons 15 and 17, a single stepped annular piston 251 is provided for this purpose; it works in conjunction with a stop 252. The annular piston 251 is moveable longitudinally with respect to both the cylindrical drum 4 and the drive shaft 3. In the rest position of the axial piston machine, the pressure spring 11 presses the annular piston 251 and the stop 252 apart into an initial end position, in which the annular piston 251 lies on the collar 3*a* of the drive shaft 3, the stop 252 lies on the retaining ring 16 on the cylindrical drum 4 and the pressure spring 11 has the greatest possible axial extension. The graduation of the annular piston 251 facilitates the development of two annular spaces 181 and 182, which can be loaded with high pressure depending on the direction of flow of the medium. Above a certain load or a certain pressure in one of the two annular spaces 181 or 182, the pressure spring 11 is compressed with the aid of the annular piston 251 and separated by the collar 3*a* until the annular piston 251 lies on the stop 252 in a second end position. The pressure spring 11 has its smallest possible axial extension in this position and cannot be further compressed. Although the pressure spring 11 is indeed tensioned, it still does not act on the cylindrical drum 4 to increase the pressing force on the control surface 5. The compressive force of the pressure spring Il is continuously reduced or increased between the two end positions by the load-dependent pressure rise in one of the two annular spaces 181 or 182.

Having described presently preferred embodiments of the invention, it is to be understood that the invention may be embodied within the scope of the appended claims.

What is claimed is:

1. An axial piston machine having a rotary cylindrical drum with a plurality of cylindrical bores formed therein, said bores arranged concentrically to the axis of rotation of said drum, a longitudinally sliding piston located in each of said bores, means forming a control surface in contact with an end of said drum, said pistons being in contact with a second control surface that can be positioned diagonally to the axis of rotation of said drum, said drum having connecting openings in flow communication with said cylindrical bores and with control channels in said means forming said control surface, a drive shaft supporting said cylindrical drum for axial movement, an annular cavity formed in said cylindrical drum and means in said annular cavity for controlling the pressing force of said end of said cylindrical drum on said control surface in working connection with said cylindrical drum and in a direction opposite to said control surface, said means in said annular cavity including at least one piston surface that can be acted upon by operating pressure and wherein said means comprises an annular piston arranged co-axially to the axis of rotation between a cylindrical outer surface of said drive shaft and a cylindrical inner surface of said cylindrical drum, said annular piston being moveable longitudinally both with respect to said cylindrical drum and said drive shaft and having a cylindrical outer surface in connection with a hollow cylindrical inner surface of said cylindrical drum forming at least one annular space, whereby in the pressureless state of said axial piston machine said annular piston has an initial end position in which a pressure spring located between said hollow cylindrical inner surface of said annular piston and said cylindrical outer surface of said drive shaft has as great an axial extension as possible and said annular piston lies against a stop formed on said drive shaft and a second end position of said annular piston is provided wherein at a certain loading of said axial piston machine said pressure spring has as small an axial extension as possible and said annular piston lies against a stop of said cylindrical drum.

2. An axial piston machine having a rotary cylindrical drum with a plurality of cylindrical bores formed therein, said bores arranged concentrically to the axis of rotation of said drum, a longitudinally sliding piston located in each of said bores, means forming a control surface in contact with an end of said drum, said pistons being in contact with a second control surface that can be positioned diagonally to the axis of rotation of said drum, said drum having connecting openings in flow communication with said cylindrical bores and with control channels in said means forming said control surface, means for supporting said cylindrical drum for axial movement, an annular cavity formed in said cylindrical drum and means in said annular cavity in working connection with said cylindrical drum for controlling the pressing force of said end of said cylindrical drum on said control surface, said means in said annular cavity including at least one piston surface that can be acted upon by operating pressure, at least one control channel in said means forming a control surface and a connecting channel located in said cylindrical drum between the annular space and one of the control channels in said means forming a control surface, and a plurality of connecting channels spaced concentrically from the axis of rotation of said drum on a first graduated circle with approximately the same angular spacing from each other for a first direction of flow and a plurality of connecting channels spaced concentrically from the axis of rotation of said drum on a second graduated circle with approximately the same angular amount from each other for a second direction of flow.

3. An axial piston machine having a rotary cylindrical drum with a plurality of cylindrical bores formed therein, said bores arranged concentrically to the axis of rotation of said drum, a longitudinally sliding piston located in each of said bores, means forming a control surface in contact with an end of said drum, said pistons being in contact with a second control surface that can be positioned diagonally to the axis of rotation of said drum, said drum having connecting openings in flow communication with said cylindrical bores and with control channels in said means forming said control surface, a drive shaft supporting said cylindrical drum for axial movement, an annular cavity formed in said cylindrical drum and means in said cavity for controlling the pressing force of said end of said cylindrical drum on said control surface in working connection with said cylindrical drum in a direction opposite said control surface, said means in said annular cavity comprising an annular piston arranged co-axially with the axis of rotation of said cylindrical drum between a cylindrical outer surface of said drive shaft and a cylindrical inner surface of said cylindrical drum, said annular piston being moveable longitudinally both with respect to said cylindrical drum and said drive shaft and having a cylindrical outer surface in connection with a cylindrical inner surface of said cylindrical drum forming at least one annular space, whereby in the pressureless state of the axial piston machine said annular piston has an initial end position in which a pressure spring located between said hollow cylindrical inner surface of said annular piston and said cylindrical outer surface of said drive shaft has as great an axial extension as possible and said annular piston lies against a stop formed on said drive shaft and a second end position of the annular piston is provided wherein at a certain loading of said axial piston machine said pressure spring has as small an axial extension as possible and said annular piston lies against a stop of said cylindrical drum, and means for adjusting the delivery volume and reversal of the direction of flow of the delivery medium, wherein at least one annular space and at least one connecting channel is assigned to each direction of flow and wherein for a first direction of flow a plurality of connecting channels are spaced concentrically from the axis of rotation of said drum on a first graduated circle with approximately the same angular spacing from each other and a plurality of connecting channels are spaced concentrically from the axis of rotation of said drum on a second graduated circle with approximately the same angular amount from each other for a second direction of flow.

* * * * *